US012297551B2

(12) United States Patent
Kobayashi et al.

(10) Patent No.: US 12,297,551 B2
(45) Date of Patent: May 13, 2025

(54) ORGANIC HYDRIDE PRODUCTION DEVICE AND METHOD FOR REUSING DRAGGED WATER

(71) Applicant: ENEOS Corporation, Tokyo (JP)

(72) Inventors: Atsushi Kobayashi, Tokyo (JP); Kota Miyoshi, Tokyo (JP); Tomomi Nagatsuka, Tokyo (JP); Toru Takamura, Tokyo (JP); Koji Matsuoka, Tokyo (JP)

(73) Assignee: ENEOS Corporation, Tokyo (JP)

( * ) Notice: Subject to any disclaimer, the term of this patent is extended or adjusted under 35 U.S.C. 154(b) by 0 days.

(21) Appl. No.: 18/254,445

(22) PCT Filed: Dec. 2, 2021

(86) PCT No.: PCT/JP2021/044347

§ 371 (c)(1),
(2) Date: May 25, 2023

(87) PCT Pub. No.: WO2022/118932

PCT Pub. Date: Jun. 9, 2022

(65) Prior Publication Data

US 2024/0102184 A1 Mar. 28, 2024

(30) Foreign Application Priority Data

Dec. 4, 2020 (JP) ..... 2020-201823

(51) Int. Cl.
*C25B 3/25* (2021.01)
*C25B 9/23* (2021.01)
(Continued)

(52) U.S. Cl.
CPC ..... *C25B 3/25* (2021.01); *C25B 9/23* (2021.01); *C25B 9/60* (2021.01); *C25B 15/083* (2021.01); *C25B 15/087* (2021.01)

(58) Field of Classification Search
None
See application file for complete search history.

(56) References Cited

U.S. PATENT DOCUMENTS

2019/0352786 A1 11/2019 Mitsushima et al.
2020/0240023 A1 7/2020 Cave et al.

FOREIGN PATENT DOCUMENTS

DE 102019205316 A1 10/2020
JP 2018031046 A 3/2018
WO 2012091128 A1 7/2012

OTHER PUBLICATIONS

Machine translation of Hanebuth et al. DE 102019205316 A1 (Year: 2020).*

(Continued)

*Primary Examiner* — Wojciech Haske
(74) *Attorney, Agent, or Firm* — BUCHANAN, INGERSOLL & ROONEY PC

(57) ABSTRACT

An organic hydride production device comprises: an electrolyzer having an anode electrode that oxidizes water to generate a proton, a cathode electrode that hydrogenates a substance to be hydrogenated with the proton to generate an organic hydride, and a membrane that moves the proton together with dragged water from the side of the anode electrode to the side of the cathode electrode; an anolyte supplier that supplies the anolyte to the anode electrode; a water separator that separates the dragged water from the catholyte fed from the cathode electrode; and a water returner that sends the dragged water separated by the water separator to the anolyte supplier.

5 Claims, 2 Drawing Sheets

(51) Int. Cl.
*C25B 9/60* (2021.01)
*C25B 15/08* (2006.01)

(56) References Cited

OTHER PUBLICATIONS

International Preliminary Report on Patentability Chapter I (PCT/IB/373) with translation mailed on May 30, 2023 by The International Bureau of WIPO in corresponding International Patent Application No. PCT/JP2021/044347. (10 pages).
International Search Report (PCT/ISA/210) with translation mailed on Jan. 11, 2022 by the Japanese Patent Office as the International Searching Authority for International Application No. PCT/JP2021/044347. (5 pages).
Extended European Search Report issued in EP Application No. 21900682.2; Mailed Mar. 21, 2025. 7 Pages.

* cited by examiner

ORGANIC HYDRIDE PRODUCTION DEVICE AND METHOD FOR REUSING DRAGGED WATER

CROSS-REFERENCE TO RELATED APPLICATIONS

This application is based upon and claims the benefit of priority from the prior Japanese Patent Application No. 2020-201823, filed on Dec. 4, 2020, and International Patent Application No. PCT/JP2021/044347, filed on Dec. 2, 2021, the entire content of each of which is incorporated herein by reference.

BACKGROUND

Field of the Invention

The present invention relates to an organic hydride production device and a method for reusing dragged water (water dragged by electro-osmosis).

Description of the Related Art

Conventionally, an organic hydride production device including an electrolyzer having an anode electrode for generating protons from water, a cathode electrode for hydrogenating an organic compound (substance to be hydrogenated) having an unsaturated bond, and a membrane for separating the anode electrode and the cathode electrode is known (see, for example, Patent Literature 1). In this organic hydride production device, protons are generated by oxidation of water in the anode electrode, the protons move to the side of the cathode electrode through the membrane, and the substance to be hydrogenated is hydrogenated by the protons in the cathode electrode, so that an organic hydride is produced.

Patent Literature 1: WO2012/091128A

According to the above-described organic hydride production device, generation of the protons and hydrogenation of the substance to be hydrogenated can be performed by a one-step process. Therefore, the process for producing the organic hydride can be simplified as compared with a case where the organic hydride is produced by a two-step process in which hydrogen is produced by water electrolysis or the like and the substance to be hydrogenated is chemically hydrogenated in a reactor such as a plant. Or, production efficiency of the organic hydride can be improved. In addition, since it is possible to omit a high-pressure container for storing hydrogen which is required in the case of producing hydrogen by water electrolysis or the like, it is expected that equipment cost will be greatly reduced.

As a result of intensive studies on the conventional organic hydride production device, the present inventors have found that there is room for improving the operation efficiency of the conventional organic hydride production device.

SUMMARY OF THE INVENTION

The present invention has been made in view of such a situation, and an object thereof is to provide a technique for improving operation efficiency of an organic hydride production device.

One aspect of the present invention is an organic hydride production device. This device includes: an electrolyzer having an anode electrode that oxidizes water in an anolyte to generate a proton, a cathode electrode that hydrogenates a substance to be hydrogenated in a catholyte with the proton to generate an organic hydride, and a membrane that is disposed between the anode electrode and the cathode electrode and moves the proton together with dragged water from the side of the anode electrode to the side of the cathode electrode; an anolyte supplier that supplies the anolyte to the anode electrode; a water separator that separates the dragged water from the catholyte fed from the cathode electrode; and a water returner that sends the dragged water separated by the water separator to the anolyte supplier.

Another aspect of the present invention is a method for reusing dragged water. This method includes: in an electrolyzer having an anode electrode that oxidizes water in an anolyte to generate a proton, a cathode electrode that hydrogenates a substance to be hydrogenated in a catholyte with the proton to generate an organic hydride, and a membrane that is disposed between the anode electrode and the cathode electrode and moves the proton together with the dragged water from the side of the anode electrode to the side of the cathode electrode, separating the dragged water from the catholyte fed from the cathode electrode; and reusing the separated dragged water in the anode electrode.

Any combinations of the above components and conversion of the expressions in the present disclosure between methods, devices, systems, and the like are also effective as aspects of the present disclosure.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
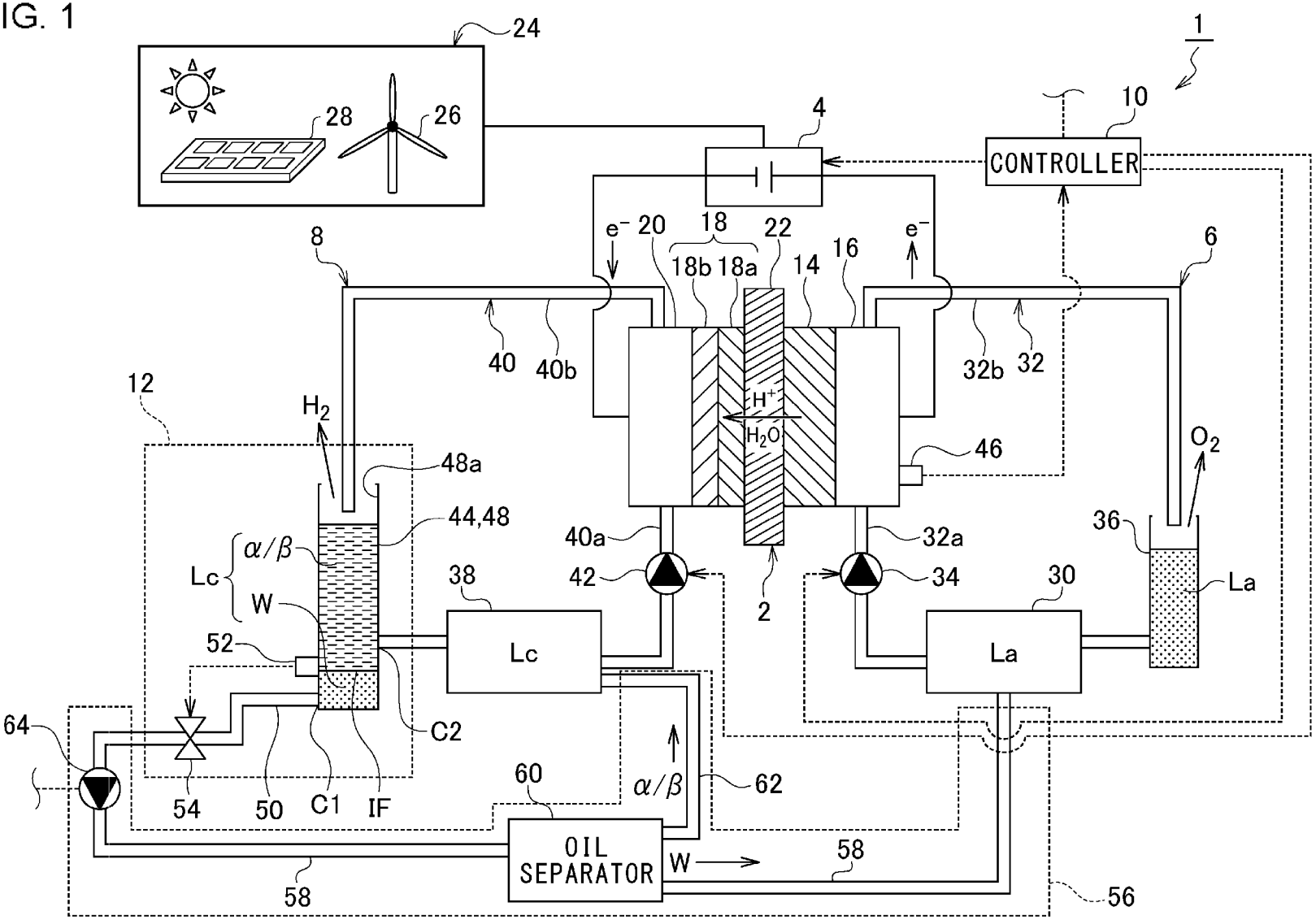
FIG. 1 is a schematic view of an organic hydride production device according to an embodiment.

Hereinafter, the present invention will be described based on preferred embodiments with reference to the drawings. The embodiments are illustrative rather than limiting the invention, and all features described in the embodiments and combinations thereof are not necessarily essential to the invention. The same or equivalent components, members, and processes illustrated in the drawings are denoted by the same reference numerals, and redundant description will be omitted as appropriate.

In addition, the scale and shape of each part illustrated in each drawing are set for convenience in order to facilitate the description, and are not to be limitedly interpreted unless otherwise specified. Furthermore, when the terms "first", "second", and the like are used in the present specification or claims, the terms do not represent any order or importance, but are used to distinguish one configuration from another configuration. In addition, in each drawing, some of members that are not important for describing the embodiments are omitted.

FIG. 1 is a schematic view of an organic hydride production device 1 according to an embodiment. The organic hydride production device 1 includes an electrolyzer 2, a power supply 4, an anolyte supplier 6, a catholyte supplier 8, a controller 10, a water separator 12, and a water returner 56.

The electrolyzer 2 generates an organic hydride β by hydrogenating a substance to be hydrogenated α by an electrochemical reduction reaction. The electrolyzer 2 has an anode electrode 14, an anode chamber 16, a cathode electrode 18, a cathode chamber 20, and a membrane 22.

The anode electrode 14 (anode) oxidizes water in an anolyte La to generate protons. The anode electrode 14 is disposed so as to be in contact with one main surface of the membrane 22. The anode electrode 14 has, for example, a metal such as iridium (Ir), ruthenium (Ru), or platinum (Pt), or a metal oxide thereof as an anode catalyst. In the anode electrode 14 as an example, the anode catalyst is dispersedly supported or coated on a base material having electron conductivity. The base material includes a material containing, for example, a metal such as titanium (Ti) or stainless steel (SUS) as a main component. Examples of the form of the base material include a woven fabric sheet or a nonwoven fabric sheet, a mesh, a porous sintered body, a foamed molded body (foam), and an expanded metal. Note that the anode catalyst may be coated on the base material to form a catalyst layer. The anode electrode 14 may be obtained by directly coating the main surface of the membrane 22 with the anode catalyst.

The anode electrode 14 is equipped in the anode chamber 16. A space excluding the anode electrode 14 in the anode chamber 16 forms a flow path of the anolyte La and oxygen generated by an electrode reaction.

The cathode electrode 18 (cathode) hydrogenates the substance to be hydrogenated α in a catholyte Lc with protons to generate the organic hydride β. The cathode electrode 18 is disposed so as to be in contact with the other main surface (main surface opposite to the anode electrode 14) of the membrane 22. The cathode electrode 18 has a catalyst layer 18*a* and a diffusion layer 18*b*.

The catalyst layer 18*a* is disposed so as to be in contact with the membrane 22. The catalyst layer 18*a* contains, for example, platinum or ruthenium as a cathode catalyst. It is preferable that the catalyst layer 18*a* also has a catalyst support that supports the cathode catalyst. The catalyst support includes an electron-conductive material such as porous carbon, a porous metal, or a porous metal oxide.

The diffusion layer 18*b* is disposed to be in contact with a surface of the catalyst layer 18*a* on a side opposite to the membrane 22. The diffusion layer 18*b* uniformly diffuses the liquid substance to be hydrogenated α supplied from the outside into the catalyst layer 18*a*. The organic hydride β generated in the catalyst layer 18*a* is discharged from the catalyst layer 18*a* through the diffusion layer 18*b*. The diffusion layer 18*b* is formed of a conductive material such as carbon or a metal. In addition, the diffusion layer 18*b* is a porous body such as a sintered body of fibers or particles or a foamed molded body. Specific examples of the material forming the diffusion layer 18*b* include a carbon woven fabric (carbon cloth), a carbon nonwoven fabric, and carbon paper.

The cathode electrode 18 is equipped in the cathode chamber 20. A space excluding the cathode electrode 18 in the cathode chamber 20 forms a flow path of the substance to be hydrogenated α and the organic hydride β generated by the electrode reaction.

The anode chamber 16 and the cathode chamber 20 are separated by the membrane 22. The membrane 22 is disposed between the anode electrode 14 and the cathode electrode 18. The membrane 22 as an example is formed of a solid polymer electrolyte membrane having proton conductivity. The solid polymer electrolyte membrane is not particularly limited as long as it is a proton-conducting material, and examples thereof include a fluorine-based ion exchange membrane having a sulfonic acid group such as Nafion (registered trademark). The membrane 22 moves protons from the side of the anode electrode 14 to the side of the cathode electrode 18 with water. Hereinafter, water that moves together with protons is referred to as dragged water W.

A reaction that occurs when toluene (TL) is used as an example of the substance to be hydrogenated α in the electrolyzer 2 is as follows. The organic hydride β obtained in a case where toluene is used as the substance to be hydrogenated α is methylcyclohexane (MCH).

<Electrode Reaction in Anode Electrode>

$$3H_2O \rightarrow 3/2O_2 + 6H^+ + 6e^-$$

<Electrode Reaction in Cathode Electrode>

$$TL + 6H^+ + 6e^- \rightarrow MCH$$

That is, in the anode electrode 14, water is electrolyzed to generate oxygen gas, protons, and electrons. The protons move through the membrane 22 toward the cathode electrode 18. The electrons flow into a positive electrode of the power supply 4. The oxygen gas is discharged to the outside through the anode chamber 16. In the cathode electrode 18, methylcyclohexane is generated by the reaction of toluene, electrons supplied from a negative electrode of the power supply 4, and protons having reached through the membrane 22. Therefore, according to the organic hydride production device 1 according to the present embodiment, the electrolysis of water and the hydrogenation reaction of the substance to be hydrogenated α can be performed in one step.

The power supply 4 is a DC power supply that supplies power to the electrolyzer 2. By the supply of power from the power supply 4, a predetermined electrolytic voltage is applied between the anode electrode 14 and the cathode electrode 18 of the electrolyzer 2. The power supply 4 receives power supplied from a power supplier 24 and supplies the power to the electrolyzer 2. The power supplier 24 as an example can include a renewable energy power generation device such as a wind power generation device 26, a solar power generation device 28, or the like. Note that the power supplier 24 may include a power generation device using renewable energy other than wind power and sunlight, such as a geothermal power generation device, a wave power generation device, a temperature difference power generation device, or a biomass power generation device. Note that the power supplier 24 is not limited to the power generation device that generates power using the renewable energy.

The anolyte supplier 6 supplies the anolyte La containing water to the anode electrode 14. The anolyte supplier 6 has an anolyte tank 30, an anolyte circulation path 32, an anolyte transfer device 34, and an anolyte gas-liquid separator 36. The anolyte tank 30 stores the anolyte La to be supplied to the anode electrode 14. Examples of the anolyte La include a solution having predetermined ion conductivity such as a sulfuric acid aqueous solution, a nitric acid aqueous solution, or a hydrochloric acid aqueous solution, pure water, and ion-exchanged water.

The anolyte tank 30 and the anode chamber 16 are connected by the anolyte circulation path 32. The anolyte circulation path 32 has an anode inlet pipe 32*a* that supplies the anolyte La in the anolyte tank 30 to the anode electrode 14, and an anode outlet pipe 32*b* that returns the anolyte La fed from the anode electrode 14 to the anolyte tank 30.

As an example, the anolyte transfer device 34 is provided in the middle of the anode inlet pipe 32*a*. By driving the anolyte transfer device 34, the anolyte La flows into the anolyte circulation path 32 and circulates between the anolyte tank 30 and the anode electrode 14. As the anolyte transfer device 34, for example, various pumps such as a gear pump and a cylinder pump, a natural flow-down type device, or the like can be used.

The anolyte gas-liquid separator 36 is provided in the middle of the anode outlet pipe 32*b*. In the anode electrode 14, oxygen is generated by an electrode reaction. Therefore, the anolyte La recovered from the anode electrode 14 contains gaseous oxygen and dissolved oxygen in addition to unreacted water. The gaseous oxygen is separated from the anolyte La in the anolyte gas-liquid separator 36 and taken out of the system. The anolyte La from which the oxygen has been separated is recovered in the anolyte tank 30.

In the anolyte supplier 6 as an example, the anode inlet pipe 32*a* is connected to a vertically lower portion of the anode chamber 16, and the anode outlet pipe 32*b* is connected to a vertically upper portion of the anode chamber 16. The anolyte La in the anolyte tank 30 is pumped up by the anolyte transfer device 34 and enters the anode chamber 16. The anolyte La in the anode chamber 16 is pushed out to the anode outlet pipe 32*b* by the flow of the anolyte La entering the anode chamber 16, and flows down to the anolyte gas-liquid separator 36 by the gravity. The anolyte La is placed under the atmospheric pressure in the anolyte gas-liquid separator 36. The anolyte La in the anolyte gas-liquid separator 36 flows into the anolyte tank 30 in a natural flow-down manner as a liquid level in the anolyte tank 30 decreases. Note that the anode inlet pipe 32*a* may be connected to the vertically upper portion of the anode chamber 16, and the anolyte La may enter the anode chamber 16 from the vertically upper portion.

The catholyte supplier 8 supplies the catholyte Lc containing the substance to be hydrogenated α to the cathode electrode 18. The catholyte supplier 8 has a catholyte tank 38, a catholyte circulation path 40, a catholyte transfer device 42, and a catholyte gas-liquid separator 44. The catholyte tank 38 stores the catholyte Lc supplied to the cathode electrode 18. The catholyte Lc stored in the catholyte tank 38 contains at least the substance to be hydrogenated α before the operation of the organic hydride production device 1 is started. The substance to be hydrogenated α is a compound that is hydrogenated by an electrochemical reduction reaction in the electrolyzer 2 to become the organic hydride β, in other words, a dehydrogenated product of the organic hydride β. The substance to be hydrogenated α and the organic hydride β are preferably a liquid at 20° C. and 1 atm.

The substance to be hydrogenated α and the organic hydride β are organic compounds capable of adding/eliminating hydrogen by reversibly causing a hydrogenation reaction/dehydrogenation reaction. The substance to be hydrogenated α and the organic hydride β have specific gravities smaller than that of water. Further, the substance to be hydrogenated α and the organic hydride β have low compatibility with water, and form an interface IF with the dragged water W.

In a case where a detector 52 described later includes a sensor that detects the interface IF based on a difference in buoyancy (specific gravity) applied to a float, the substance to be hydrogenated α and the organic hydride β having a difference in specific gravity with respect to the dragged water W to such an extent that the sensor can perform detection are selected. In this case, examples of the substance to be hydrogenated α include an aromatic compound in which the specific gravity of the liquid is 0.6 to 0.9 g/cm$^3$. In addition, in a case where the detector 52 includes a sensor that detects the interface IF based on a difference in capacitance (relative permittivity), the substance to be hydrogenated α and the organic hydride β having a difference in relative permittivity with respect to the dragged water W to such an extent that the sensor can perform detection are selected. In this case, examples of the substance to be hydrogenated α include an aromatic compound in which the relative permittivity is 1 to 50. Specific examples of the substance to be hydrogenated α include alkylbenzenes such as benzene and toluene, and nitrogen-containing aromatic compounds such as pyridine and pyrazine.

The catholyte tank 38 and the cathode chamber 20 are connected by the catholyte circulation path 40. The catholyte circulation path 40 has a cathode inlet pipe 40*a* that supplies the catholyte Lc in the catholyte tank 38 to the cathode electrode 18, and a cathode outlet pipe 40*b* that returns the catholyte Lc fed from the cathode electrode 18 to the catholyte tank 38. In the catholyte Lc flowing through the catholyte circulation path 40, as the operation time of the organic hydride production device 1 elapses, in other words, as the number of circulations increases, the concentration of the substance to be hydrogenated α decreases, and the concentration of the organic hydride β increases.

As an example, the catholyte transfer device 42 is provided in the middle of the cathode inlet pipe 40*a*. By driving the catholyte transfer device 42, the catholyte Lc flows into the catholyte circulation path 40 and circulates between the catholyte tank 38 and the cathode electrode 18. As the catholyte transfer device 42, for example, various pumps such as a gear pump and a cylinder pump, a natural flow-down type device, or the like can be used.

The catholyte gas-liquid separator 44 is provided in the middle of the cathode outlet pipe 40*b*. In the cathode electrode 18, hydrogen is generated by a side reaction. As the supply amount of the substance to be hydrogenated α to the cathode electrode 18 becomes insufficient, this side reaction is likely to occur. Therefore, the catholyte Lc recovered from the cathode electrode 18 contains gaseous hydrogen and dissolved hydrogen in addition to the unreacted substance to be hydrogenated α and the generated organic hydride β. The gaseous hydrogen is separated from the catholyte Lc in the catholyte gas-liquid separator 44 and taken out of the system. The catholyte Lc from which hydrogen has been separated is recovered in the catholyte tank 38.

In the catholyte supplier 8 as an example, the cathode inlet pipe 40*a* is connected to the vertically lower portion of the cathode chamber 20, and the cathode outlet pipe 40*b* is connected to the vertically upper portion of the cathode chamber 20. The catholyte Lc in the catholyte tank 38 is pumped up by the catholyte transfer device 42 and enters the cathode chamber 20. The catholyte Lc in the cathode chamber 20 is pushed out to the cathode outlet pipe 40*b* by the flow of the catholyte Lc entering the cathode chamber 20, and flows down to the catholyte gas-liquid separator 44 by the gravity. The catholyte Lc is placed under the atmospheric pressure in the catholyte gas-liquid separator 44. The catholyte Lc in the catholyte gas-liquid separator 44 flows into the catholyte tank 38 in a natural flow-down manner as a liquid level in the catholyte tank 38 decreases. Note that the cathode inlet pipe 40*a* may be connected to the vertically upper portion of the cathode chamber 20, and the catholyte Lc may enter the cathode chamber 20 from the vertically upper portion.

The controller 10 controls the operation of the organic hydride production device 1. The controller 10 is realized by an element or a circuit such as a CPU or a memory of a computer as a hardware configuration, and is realized by a computer program or the like as a software configuration, but is illustrated as a functional block realized by cooperation between them in FIG. 1. It should be understood by those skilled in the art that the functional blocks can be implemented in various forms by a combination of hardware and software.

At least one of a signal indicating a voltage of the electrolyzer 2, a signal indicating a potential of the anode electrode 14, and a signal indicating a potential of the cathode electrode 18 is input to the controller 10 from a sensor 46 provided in the electrolyzer 2. The sensor 46 can detect the potential of each electrode and the voltage of the electrolyzer 2 by a known method. The sensor 46 as an example includes a known voltmeter or the like. The sensor 46 may include a current detector that detects a current flowing between the anode electrode 14 and the cathode electrode 18. The controller 10 controls the power supply 4, the anolyte transfer device 34, the catholyte transfer device 42, and the like based on a detection result of the sensor 46.

The water separator 12 separates the dragged water W from the catholyte Lc. As described above, the dragged water W moves from the side of the anode electrode 14 to the side of the cathode electrode 18. Therefore, the catholyte Lc fed from the cathode electrode 18 contains not only the substance to be hydrogenated α and the organic hydride β but also the dragged water W. The water separator 12 separates the dragged water W from the catholyte Lc.

The water separator 12 has a container 48, a drain pipe 50, a detector 52, and a switcher 54. The container 48 stores the catholyte Lc fed from the cathode electrode 18. The container 48 of the present embodiment is provided in the middle of the cathode outlet pipe 40*b* and also serves as the catholyte gas-liquid separator 44. Therefore, an exhaust port 48*a* for discharging hydrogen in the catholyte Lc is provided in a vertically upper portion of the container 48. The substance to be hydrogenated α and the organic hydride β have specific gravities smaller than that of the dragged water W and have incompatibility with the dragged water W. Therefore, the catholyte Lc is divided into a lower layer (water layer) containing the dragged water W and an upper layer (oil layer) containing the substance to be hydrogenated α and the organic hydride β in the container 48.

The drain pipe 50 is connected to the container 48 to discharge the dragged water W accumulated in the container 48. One end of the drain pipe 50 and one end of the cathode outlet pipe 40*b* are connected to the container 48. The other end of the cathode outlet pipe 40*b* is connected to the catholyte tank 38. A connection position C1 of the drain pipe 50 with respect to the container 48 (catholyte gas-liquid separator 44) is disposed below a connection position C2 of the cathode outlet pipe 40*b* with respect to the container 48 in a vertical direction.

The detector 52 detects that a predetermined amount of dragged water W has been accumulated in the container 48. The "predetermined amount" can be appropriately set based on an experiment or a simulation. The detector 52 according to the present embodiment includes an interface sensor that detects an interface IF between a layer containing the substance to be hydrogenated α and the organic hydride β in the catholyte Lc and a layer containing the dragged water W. In the detector 52, a known interface sensor such as a float type interface sensor, a capacitance type interface sensor, or a conductivity type interface sensor can be used. In addition, a person skilled in the art can appropriately select a combination of the types of the substance to be hydrogenated α and the organic hydride β and the detection type of the interface sensor.

A detection position of the interface IF by the detector 52 is set below the connection position C2 of the cathode outlet pipe 40*b* in the vertical direction. The detection position of the interface IF is set above the connection position C1 of the drain pipe 50 in the vertical direction. The detector 52 is disposed inside the container 48, for example. Note that, when the container 48 does not hinder the detection of the interface IF (for example, when the container 48 is made of a material capable of detecting the capacitance inside the container from the outside of the container), the detector 52 may be disposed outside the container 48. The detector 52 can detect accumulation of a predetermined amount of dragged water W in the container 48 by detecting the interface IF. When the detector 52 detects the interface IF, the detector 52 transmits a control signal to the switcher 54.

The switcher 54 is provided in the drain pipe 50. The switcher 54 includes a mechanism capable of switching between a regulation state in which drainage from the drain pipe 50 is regulated and an execution state in which drainage from the drain pipe 50 is executed. The switcher 54 of the present embodiment includes a valve. As the valve included in the switcher 54, for example, a known electromagnetic valve, an air drive valve, or the like can be used. Preferably, the valve included in the switcher 54 is a normally closed type valve that is closed at the time of non-energization and opened at the time of energization. In a state where the switcher 54 is closed, discharge of the dragged water W from the drain pipe 50 is regulated. When the switcher 54 is opened, discharge of the dragged water W from the drain pipe 50 is permitted and drainage is executed.

The switcher 54 opens the valve based on the detection result of the detector 52. That is, when the water level (interface IF) of the dragged water W rises to a detection position of the detector 52, the switcher 54 receives the control signal from the detector 52, is energized, and opens the valve, and the dragged water W is automatically discharged from the container 48. The amount of the dragged water W accumulated in the container 48 until the switcher 54 opens the valve is determined according to the size of the container 48 or the detection position of the interface IF.

When a predetermined time elapses after the valve opening, the switcher 54 closes the valve and regulates drainage. For example, a valve opening time of the switcher 54 is adjusted such that the valve is closed before the interface IF reaches the connection position C1 of the drain pipe 50. The valve opening time can be set in advance based on the amount of the dragged water W accumulated in the container 48 when the switcher 54 opens the valve, the drainage speed from the drain pipe 50, and the like. As a result, it is possible to suppress the substance to be hydrogenated α and the organic hydride β from being discharged from the drain pipe 50. The valve closing of the switcher 54 (switching to the regulation state) may be realized by control of the detector 52, or may be realized by a timer or the like that stops energization to the switcher 54 after a predetermined time elapses.

Note that the valve opening and closing of the switcher 54 may be controlled as follows. That is, the detector 52 has two interface sensors, and one interface sensor is disposed below the other interface sensor. A detection position of the interface IF by the upper interface sensor is set below the connection position C2, and a detection position of the interface IF by the lower interface sensor is set above the connection position C1. When the dragged water W is gradually accumulated and the interface IF rises, the interface IF is detected by the upper interface sensor. As a result, the switcher 54 is opened, the dragged water W is discharged, and the interface IF falls. When the interface IF is detected by the lower interface sensor, the switcher 54 is closed. This control can also suppress the substance to be hydrogenated α and the organic hydride β from being discharged from the drain pipe 50.

The switcher 54 can also include a pump. In this case, the switcher 54 receives the control signal from the detector 52, is driven, and executes drainage. In addition, the switcher 54 stops driving and regulates drainage, when a predetermined time elapses from execution of drainage.

The water returner 56 sends the dragged water W separated by the water separator 12 to the anolyte supplier 6. The water returner 56 of the present embodiment has a water return pipe 58, an oil separator 60, an oil returner 62, and a dragged water transfer device 64. The water return pipe 58 has one end connected to the drain pipe 50 and the other end connected to the anolyte supplier 6. For example, the other end of the water return pipe 58 is connected to the anolyte tank 30. The dragged water transfer device 64 is provided in the middle of the water return pipe 58. In FIG. 1, the dragged water transfer device 64 is installed between the water separator 12 and the oil separator 60. However, the present invention is not limited thereto, and the dragged water transfer device 64 may be disposed between the oil separator 60 and the anolyte supplier 6. As the dragged water transfer device 64, for example, various pumps such as a gear pump and a cylinder pump, a natural flow-down type device, or the like can be used. Driving of the dragged water transfer device 64 is controlled by the controller 10. For example, the dragged water transfer device 64 is driven in conjunction with the valve opening of the switcher 54. As a result, the dragged water W discharged from the drain pipe 50 flows into the anolyte tank 30 through the water return pipe 58.

The oil separator 60 is provided in the middle of the water return pipe 58. The substance to be hydrogenated α or the organic hydride β is dissolved in the dragged water W. Therefore, the dragged water W contains at least one of the substance to be hydrogenated α and the organic hydride β as an oil component. The oil separator 60 separates the oil component contained in the dragged water W from the dragged water W. The oil separator 60 as an example has a filter that separates the oil component from the dragged water W by selectively adsorbing the oil component or the like. As a result, the oil component can be physically or chemically separated from the dragged water W. Examples of the filter include an activated carbon filter, a ceramic membrane filter, and a PTFE hollow fiber membrane module.

The oil separator 60 as another example cools or heats the dragged water W, and separates the oil component from the dragged water W based on a boiling point difference between the water and the oil component. For example, when the substance to be hydrogenated α is toluene, the oil separator 60 can extract toluene and methylcyclohexane as oil components from the dragged water W by heating and distilling the dragged water W. For example, when the organic hydride production device 1 is adjacent to a power plant or a petroleum refining plant and heat generated in each device of the plant can be used, such heat can be used for distillation.

The oil separator 60 as another example has a coalescer. The coalescer flocculates and coarsens the oil component in the dragged water W. As a result, the oil component can be separated from the dragged water W based on a difference in specific gravity between the water and the oil component.

The oil returner 62 sends the oil component separated by the oil separator 60 to the catholyte supplier 8. The oil returner 62 of the present embodiment includes a pipe connected to the oil separator 60 and the catholyte tank 38. An oil transfer device such as a pump may be provided in the pipe included in the oil returner 62 as necessary. When the oil separator 60 includes a filter that can be regenerated by heating, the oil component adsorbed by the filter can be extracted by heating the filter with heat generated in each device of a power plant or a petroleum refining plant. Note that the installation of the oil returner 62 can be omitted. For example, in a case where it is difficult to extract the oil component from the filter, or in a case where operation efficiency is more excellent when the filter is replaced than when oil returning is performed, the oil returner 62 may not be provided.

In the above description, the catholyte Lc circulates between the catholyte tank 38 and the cathode chamber 20. However, the present invention is not limited thereto, and the catholyte Lc fed from the cathode chamber 20 may not be returned to the catholyte tank 38. In this case, the catholyte Lc fed from the cathode chamber 20 can be stored in an organic hydride tank (not illustrated in the drawings) after passing through the catholyte gas-liquid separator 44. In the above description, the catholyte Lc fed from the cathode chamber 20 contains the unreacted substance to be hydrogenated α. However, the present invention is not limited thereto, and there may be a case where all of the substance to be hydrogenated α supplied to the cathode chamber 20 are converted into the organic hydride β, and the substance to be hydrogenated α are not contained in the catholyte Lc fed from the cathode chamber 20.

Although only one electrolyzer 2 is illustrated in FIG. 1, the organic hydride production device 1 may have a plurality of electrolyzers 2. In this case, the respective electrolyzers 2 are arranged in the same direction such that the anode chamber 16 and the cathode chamber 20 are arranged in the same direction, and are stacked with an electric conduction plate interposed between the adjacent electrolyzers 2. As a result, the electrolyzers 2 are electrically connected in series. The electric conduction plate includes a conductive material such as a metal. Note that the electrolyzers 2 may be connected in parallel, or may be a combination of series connection and parallel connection.

As described above, the organic hydride production device 1 according to the present embodiment includes the electrolyzer 2, the anolyte supplier 6, the water separator 12, and the water returner 56. The electrolyzer 2 has the anode electrode 14 that oxidizes water in the anolyte La to generate protons, the cathode electrode 18 that hydrogenates the substance to be hydrogenated α in the catholyte Lc with the protons to generate the organic hydride β, and the membrane 22 that is disposed between the anode electrode 14 and the cathode electrode 18 and moves the protons together with the dragged water W from the side of the anode electrode 14 to the side of the cathode electrode 18. The anolyte supplier 6 supplies the anolyte La to the anode electrode 14. The water separator 12 separates the dragged water W from the catholyte Lc fed from the cathode electrode 18. The water returner 56 sends the dragged water W separated by the water separator 12 to the anolyte supplier 6.

As described above, in organic hydride production using the electrolyzer 2, the protons and the dragged water W move from the side of the anode electrode 14 to the side of the cathode electrode 18. The dragged water W moved to the side of the cathode electrode 18 is fed from the electrolyzer 2 together with the catholyte Lc, and can be accumulated at the bottom of the catholyte gas-liquid separator 44 provided on the downstream side of the electrolyzer 2. In addition, when a circulation flow path is provided between the catholyte tank 38 and the electrolyzer 2, the dragged water W can also be accumulated at the bottom of the catholyte tank 38. When the amount of the retained dragged water W increases, the substance to be hydrogenated α or the organic hydride β may overflow from the catholyte gas-liquid separator 44 and the like.

By addressing this, it is conceivable to suppress the overflow of the substance to be hydrogenated α or the organic hydride β by increasing the volume of the catholyte gas-liquid separator 44 or the like in consideration of the increase in the dragged water W. However, increasing the volume of the catholyte gas-liquid separator 44 or the like causes an increase in size of the organic hydride production device. Therefore, it is desirable to discharge the dragged water W moved to the cathode side to the outside of the system. The dragged water W in the cathode electrode 18 can inhibit a reduction reaction of the substance to be hydrogenated α in the cathode electrode 18. Therefore, in this respect as well, it is desirable to discharge the dragged water W.

When the dragged water W is discharged, a tank for temporarily storing the dragged water W and a work for conveying the dragged water W are required. In addition, the substance to be hydrogenated α and the organic hydride β are dissolved in the dragged water W. Therefore, from the viewpoint of reducing the environmental load, it is required to reduce the dissolved matter in the dragged water W in the discharge treatment of the dragged water W. As a result, the discharge treatment of the dragged water W requires a large amount of labor and cost. In the actual operation of the organic hydride production device, the amount of the dragged water W generated in one operation is enormous, and the labor and cost required for the treatment of the dragged water W are larger than expected. Therefore, the treatment of the dragged water W causes a decrease in the operation efficiency of the organic hydride production device, and is a serious problem in actual production management.

On the other hand, on the anode side, water is consumed by the electrode reaction at the anode electrode 14. In addition, the water moves through the membrane 22. For this reason, the water in the anolyte La gradually decreases. Therefore, it is necessary to replenish the anode side with the water as the electrolytic reduction reaction proceeds. In order to replenish the anode side with the water, equipment such as a tank for storing the water for replenishment, water transportation work, and the like are required, which requires labor and cost.

That is, in conventional organic hydride production, the opposite treatment of removing water on the cathode side and replenishing water on the anode side is performed, and there is a great waste in terms of operation efficiency. By addressing this, in the organic hydride production device 1 according to the present embodiment, the water separator 12 separates the dragged water W from the catholyte Lc, and the water returner 56 returns the dragged water W to the anolyte supplier 6 to reuse the dragged water W. As a result, it is possible to reduce labor and cost required for the discharge treatment of the dragged water W, and it is also possible to reduce the amount of water replenished to the anode side. Therefore, the operation efficiency of the organic hydride production device 1 can be improved.

In particular, a power plant using renewable energy may be installed in a region where it is difficult to procure water. When the organic hydride production device 1 is incorporated in such a power plant, it is a major problem to secure water to be replenished to the anode side. Therefore, the reuse of the dragged water W is extremely effective in improving the operation efficiency of the organic hydride production device 1.

The water returner 56 of the present embodiment has the oil separator 60 that separates the oil component (at least one of the substance to be hydrogenated α and the organic hydride β) contained in the dragged water W from the dragged water W. The oil separator 60 as an example has a filter that adsorbs the oil component. The oil separator 60 as another example cools or heats the dragged water W, and separates the oil component from the dragged water W based on the boiling point difference between the water and the oil component. The oil separator 60 as another example has a coalescer that flocculates the oil component in the dragged water W and separates the oil component from the dragged water W. As a result, it is possible to suppress inhibition of an electrode reaction at the anode electrode 14 or deterioration of the anode electrode 14 due to movement of the oil component to the anode side.

The organic hydride production device 1 of the present embodiment includes the catholyte supplier 8 that supplies the catholyte Lc to the cathode electrode 18. The water returner 56 as an example has the oil returner 62 that sends the oil component separated by the oil separator 60 to the catholyte supplier 8. As a result, the substance to be hydrogenated α in the dragged water W can be reused. In addition, by the reuse of the substance to be hydrogenated α and the recovery of the organic hydride β, it is possible to increase a yield of the organic hydride β. Therefore, the operation efficiency of the organic hydride production device 1 can be further improved.

The water separator 12 of the present embodiment has the container 48 that stores the catholyte Lc fed from the cathode electrode 18, the drain pipe 50 that is connected to the container 48 and discharges the dragged water W, the detector 52 that detects that a predetermined amount of dragged water W has been accumulated in the container 48, and the switcher 54 that is provided in the drain pipe 50, can switch between a regulation state for regulating drainage from the drain pipe 50 and an execution state for executing drainage, and switches from the regulation state to the execution state based on a detection result of the detector 52.

As a result, it is possible to suppress the overflow of the organic hydride β and the substance to be hydrogenated α due to an increase in the dragged water W from the catholyte gas-liquid separator 44 and the like located on the downstream side of the cathode chamber 20. In addition, the size required for the catholyte gas-liquid separator 44 and the like can be reduced. Therefore, it is possible to suppress an increase in size of the organic hydride production device 1. In addition, according to the water separator 12 of the present embodiment, the dragged water W can be automatically discharged. Therefore, it is not necessary to visually confirm that the dragged water W has been accumulated in the catholyte gas-liquid separator 44 or the like, or to periodically discharge the dragged water W, and the operation efficiency of the organic hydride production device 1 can be improved.

Hereinabove, the embodiments of the present invention have been described in detail. The above-described embodiments are merely specific examples for carrying out the present invention. The contents of the embodiments do not limit the technical scope of the present invention, and many design changes such as changes, additions, and deletions of components can be made without departing from the spirit of the invention defined in the claims. A new embodiment to which the design change is made has the combined effect of each of the embodiment and the modification. In the above-described embodiment, the contents that can be subjected to such design changes are emphasized with notations such as "of the present embodiment" and "in the present embodiment", but the design changes are allowed even in the contents without such notations. Any combination of the above-described components is also effective as an aspect of the present invention.

Modification

Figure 2:
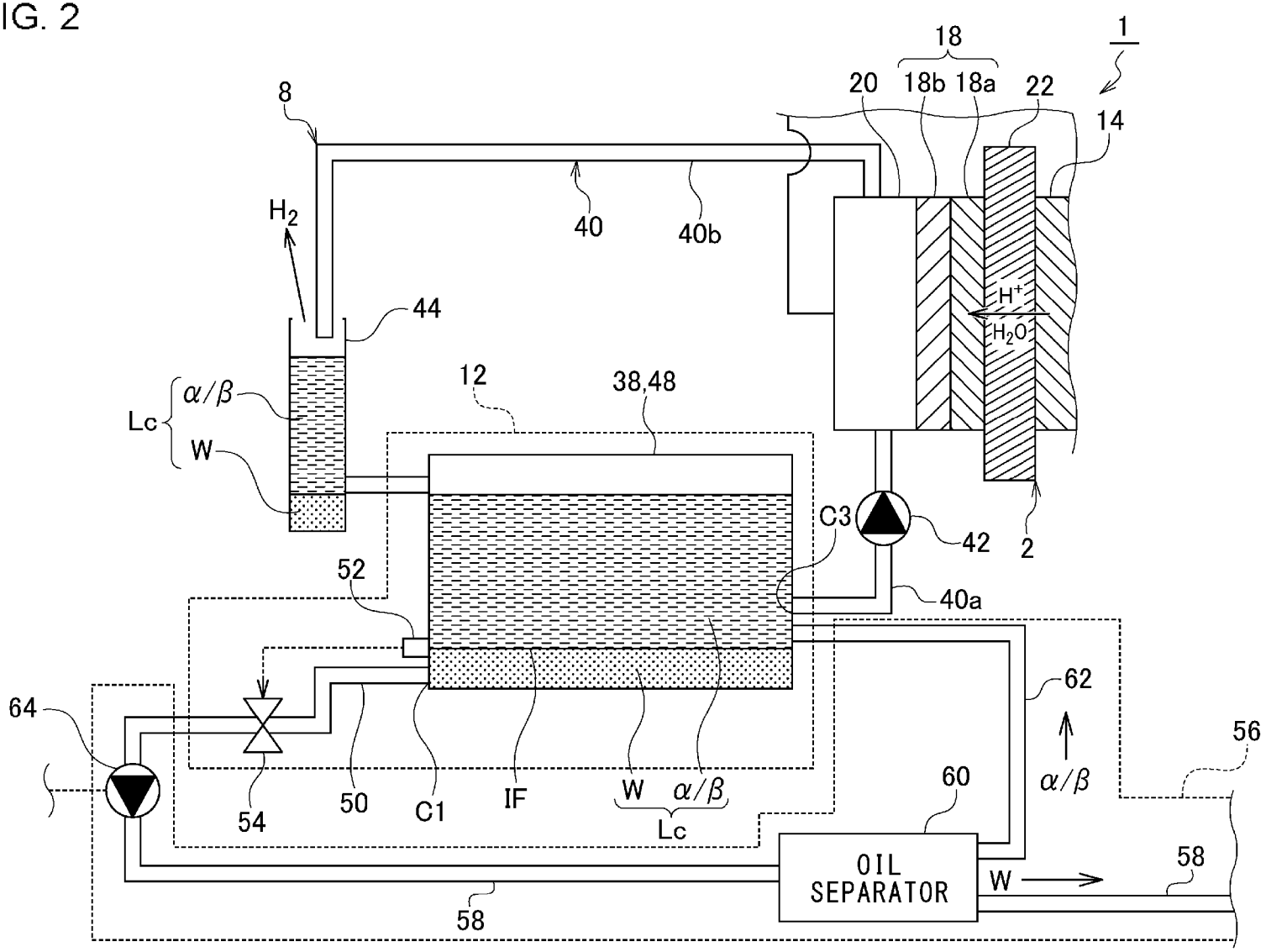
FIG. 2 is a schematic view of a part of an organic hydride production device according to a modification.

The present modification has a configuration common to the embodiment, except for the arrangement of the water separator 12. Hereinafter, the present modification will be described focusing on a configuration different from that of the embodiment, and description of the common configuration will be omitted. FIG. 2 is a schematic view of a part of an organic hydride production device 1 according to the modification. An electrolyzer 2, a power supply 4, an anolyte supplier 6, a controller 10, a power supplier 24, and a water returner 56 in the present modification include configurations similar to those of the embodiment.

The catholyte supplier 8 has a catholyte tank 38, a catholyte circulation path 40, a catholyte transfer device 42, and a catholyte gas-liquid separator 44. In the embodiment, the water separator 12 is provided in the catholyte gas-liquid separator 44, but in the present modification, the water separator 12 is provided in the catholyte tank 38. Except for this point, each configuration of the catholyte supplier 8 is similar to that of the embodiment. The water separator 12 has a container 48, a drain pipe 50, a detector 52, and a switcher 54. The container 48 of the present modification also serves as the catholyte tank 38. The catholyte Lc stored in the container 48 contains the substance to be hydrogenated α, the organic hydride β, and the dragged water W. The catholyte Lc is divided into a lower layer containing the dragged water W and an upper layer containing the substance to be hydrogenated α and the organic hydride β in the container 48.

One end of the drain pipe 50 is connected to the container 48. One end of the cathode inlet pipe 40*a* is connected to the container 48. The other end of the cathode inlet pipe 40*a* is connected to the cathode chamber 20. A connection position C1 of the drain pipe 50 with respect to the container 48 (catholyte tank 38) is disposed below a connection position C3 of the cathode inlet pipe 40*a* with respect to the container 48 in a vertical direction. Naturally, the connection position C1 is disposed below a connection position of the cathode outlet pipe 40*b* with respect to the container 48 in the vertical direction.

The detector 52 detects that a predetermined amount of dragged water W has been accumulated in the container 48. The detector 52 as an example includes an interface sensor. A detection position of the interface IF by the detector 52 is set below the connection position C3 of the cathode inlet pipe 40*a* in the vertical direction. The detection position of the interface IF is set above the connection position C1 of the drain pipe 50 in the vertical direction.

The switcher 54 is provided in the drain pipe 50. The switcher 54 of the present modification includes a valve similarly to the embodiment, and opens the valve based on a detection result of the detector 52. That is, when a water level of the dragged water W rises to the detection position of the detector 52, the switcher 54 receives a control signal from the detector 52, is energized, and opens the valve, and the dragged water W is automatically discharged from the container 48. In addition, the switcher 54 as an example closes the valve when a predetermined time elapses from the valve opening. Similarly to the embodiment, opening and closing control of the switcher 54 using two interface sensors can also be adopted. Further, the switcher 54 can include a pump.

The organic hydride production device 1 according to the present modification can also obtain effects similar to those of the organic hydride production device 1 according to the embodiment. Note that the container 48 included in the catholyte tank 38 may be provided with the exhaust port 48*a*, and the container 48 of the water separator 12 may also serve as the catholyte tank 38 and the catholyte gas-liquid separator 44. Also in the anolyte supplier 6, the anolyte gas-liquid separator 36 and the anolyte tank 30 may be integrated.

The embodiments may also be specified as the items described below.

Item 1

An organic hydride production device (1) including:

an electrolyzer (2) having an anode electrode (14) that oxidizes water in an anolyte (La) to generate a proton, a cathode electrode (18) that hydrogenates a substance to be hydrogenated (a) in a catholyte (Lc) with the proton to generate an organic hydride (β), and a membrane (22) that is disposed between the anode electrode (14) and the cathode electrode (18) and moves the proton together with dragged water (W) from the side of the anode electrode (14) to the side of the cathode electrode (18);

an anolyte supplier (6) that supplies the anolyte (La) to the anode electrode (14);

a water separator (12) that separates the dragged water (W) from the catholyte (Lc) fed from the cathode electrode (18); and a water returner (56) that sends the dragged water (W) separated by the water separator (12) to the anolyte supplier (6).

Item 2

A method for reusing dragged water (W) including:

in an electrolyzer (2) having an anode electrode (14) that oxidizes water in an anolyte (La) to generate a proton, a cathode electrode (18) that hydrogenates a substance to be hydrogenated (a) in a catholyte (Lc) with the proton to generate an organic hydride (β), and a membrane (22) that separates the anode electrode (14) and the cathode electrode (18) and moves the proton together with dragged water (W) from the side of the anode electrode (14) to the side of the cathode electrode (18), separating the dragged water (W) from the catholyte (Lc) fed from the cathode electrode (18); and reusing the separated dragged water (W) in the anode electrode (14).

The invention claimed is:

1. An organic hydride production device comprising:

an electrolyzer having an anode electrode that oxidizes water in an anolyte to generate a proton, a cathode electrode that hydrogenates a substance to be hydrogenated in a catholyte with the proton to generate an organic hydride, and a membrane that is disposed between the anode electrode and the cathode electrode and moves the proton together with the dragged water from the side of the anode electrode to the side of the cathode electrode;

an anolyte supplier structured to supply the anolyte to the anode electrode;

a water separator structured to separate the dragged water from the catholyte fed from the cathode electrode; and a water returner structured to send the dragged water separated by the water separator to the anolyte supplier, wherein the dragged water contains at least one of the substance to be hydrogenated and the organic hydride as an oil component, and the water returner has an oil separator that separates the oil component from the dragged water.

2. The organic hydride production device according to claim 1, wherein the oil separator has a filter that separates the oil component from the dragged water.

3. The organic hydride production device according to claim 1, wherein the oil separator cools or heats the dragged water, and separates the oil component from the dragged water based on a boiling point difference between water and the oil component.

4. The organic hydride production device according to claim 1, wherein the oil separator has a coalescer that flocculates the oil component in the dragged water and separates the oil component from the dragged water.

5. The organic hydride production device according to claim 1, comprising:

a catholyte supplier structured to supply the catholyte to the cathode electrode, wherein the water returner has an oil returner that sends the oil component separated by the oil separator to the catholyte supplier.

* * * * *